United States Patent [19]

McCord

[11] 4,107,790

[45] Aug. 15, 1978

[54] ULTRASONIC CLEANING APPARATUS

[76] Inventor: James W. McCord, 9101 Nottingham, Louisville, Ky. 40222

[21] Appl. No.: 838,146

[22] Filed: Sep. 30, 1977

[51] Int. Cl.[2] ..... B08B 3/12

[52] U.S. Cl. ..... 366/127; 366/118; 366/600

[58] Field of Search ..... 366/127, 114, 117, 118, 366/120, 600

[56] References Cited

U.S. PATENT DOCUMENTS

| | | | |
|---|---|---|---|
| 3,001,769 | 9/1961 | Plassmeyer | 366/118 |
| 3,318,578 | 5/1967 | Branson | 366/118 |
| 3,985,344 | 10/1976 | McCord | 366/127 |

*Primary Examiner*—Edward J. McCarthy

[57] ABSTRACT

An ultrasonic cleaning apparatus including a container for a cleaning solution with an ultrasonic vibrating member mounted therein, the vibrating member having at least three sides with at least one ultrasonic transducer attached to the inner surface of each side.

4 Claims, 4 Drawing Figures

ULTRASONIC CLEANING APPARATUS

BACKGROUND OF THE INVENTION (1) Field of the Invention

This invention relates to ultrasonic cleaning apparatuses and more particularly relates to an ultrasonic cleaning apparatus having a new, useful and non-obvious vibrating member disposed within a cleaning container for cleaning the inside surface of a container and the like.

(2) Description of the Prior Art

In recent years there has been considerable activity in the use of ultrasonic generators and transducers for producing ultrasonic vibrations causing cavitation to exist in a fluid for cleaning of objects containing soils or other types of undesirable substances thereon. The energy produced by the ultrasonic generator in combination with a transducer generally at frequencies above 16,000 cycles per second (16KHZ) when transmitted through a liquid and the vibrations generated thereby provides the energy for cleaning foreign particles from many types of objects, such as surgical instruments, metal products, optics, electronic panelboards and the like. The ultrasonic vibrations in the liquid induces rapid expansion and contraction of millions of microscopic bubbles, the implosion or collapse of these bubbles during the pressure reduction part of the cycle resulting in a powerful scrubbing action which pulls contaminants free from the parts immersed in the cleaning solution. The ultrasonic vibrations are usually transmitted to the cleaning fluid by mounting ultrasonic transducer on the exterior surface of one of the walls of the tank containing the cleaning solution, such as those described in U.S. Pat. No. 3,614,069; U.S. Pat. No. 3,001,769; U.S. Pat. No. 3,575,383; U.S. Pat. No. 2,888,939; U.S. Pat. No. 3,180,626; U.S. Pat. No. 3,318,578; U.S. Pat. No. 3,222,221; and U.S. Pat. No. 3,985,344.

SUMMARY OF THE INVENTION

In the present invention it is recognized that it is desirable to provide an ultrasonic cleaning device. It is further recognized that it is desirable to provide an ultrasonic cleaning device for continuous cleaning of inner walls of cylinders of various geometrics, and other types of material. Also, it is recognized that it is desirable to provide an ultrasonic cleaning device having improved ultrasonic vibrating characteristics.

The present invention advantageously provides a straightforward arrangement for an ultrasonic cleaning apparatus for cleaning cylinders of different types of material and configurations using ultrasonic waves transmitted in several directions within the cleaning apparatus wherein the vibrating member is mounted within the cleaning tank to transmit the ultrasonic waves in a plurality of directions.

Various other features of the present invention will become obvious to those skilled in the art upon reading the disclosure set forth hereinafter.

More particularly, the present invention provides an ultrasonic cleaning apparatus comprising: a container for a liquid; an enclosed vibrating housing mounted in the container, the housing having at least three sides; and, at least one ultrasonic transducer attached to the inner surface of each side.

It is to be understood that the description of the examples of the present invention given hereinafter are not by way of limitation. Various modifications within the scope of the present invention will occur to those skilled in the art upon reading the disclosure set forth hereinafter.

DESCRIPTION OF THE PREFERRED EMBODIMENT

Figure 1:
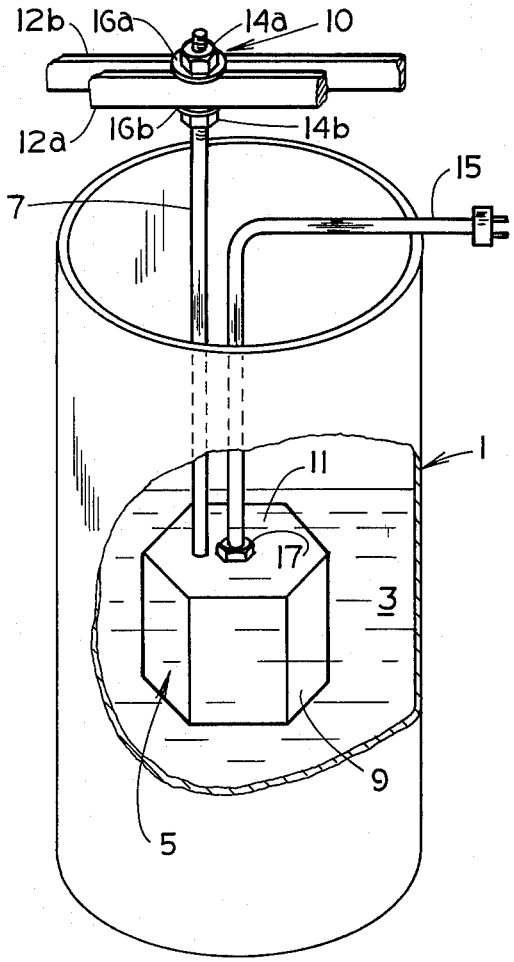
FIG. 1 is a perspective view, partially cut-away, of one ultrasonic cleaning apparatus of the present invention.

Referring now to the Figures, in FIG. 1 in particular, there is shown a container 1 with an open top filled with a cleaning solution 3 therein, the cleaning solution used being determined by the nature of the impurities to be removed and is any liquid conventionally employed for the purpose involved. Centrally disposed from each side within the container 1 is a vibrating member 5, vibrating member 5 being mounted to an external support outside container 1. The mounting for the vibrating member 5 may be any known in the art and as shown is a vertically extending vibrating absorbing rod member 7 fixedly attached to the housing 9 for the vibrating member 5 at one end and slidably attached to a horizontal extending support assembly 10 at the opposite end. Support assembly 10, as shown, includes a pair of spaced parallel elongated flat members 12*a* and 12*b* with the opposite end of rod member 7 disposed therebetween. The opposite end of rod member 7 is threaded and contains nuts 14*a* and 14*b* and washers 16*a* and 16*b* thereon to maintain rod 7 and, in turn, member 5 in supporting relation to the support assembly 10. Support assembly 10 may be attached to any support means known in the art and is not shown in the drawing.

Figure 4:
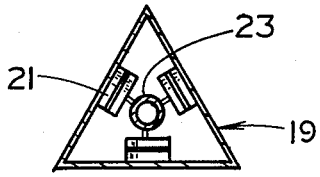

The vibrating member 5 is hexagonal in shape with a closed bottom end (not shown) and a closed top end 11. However, it is realized that the vibrating member 5 may take other shapes, such as shown in FIG. 4 and described hereinafter. Furthermore, vibrating member 5 being immersed within the cleaning solution is usually made of stainless steel or other suitable materials not subject to corrosion by the cleaning solution.

Figure 3:
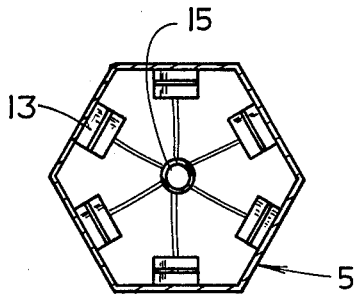
FIG. 3 is an enlarged top view of the ultrasonic vibrating member shown in FIG. 1; and, FIG. 4 is a top view of another ultrasonic vibrating member which may be used in the ultrasonic cleaning container shown in FIG. 1.
Figure 2:
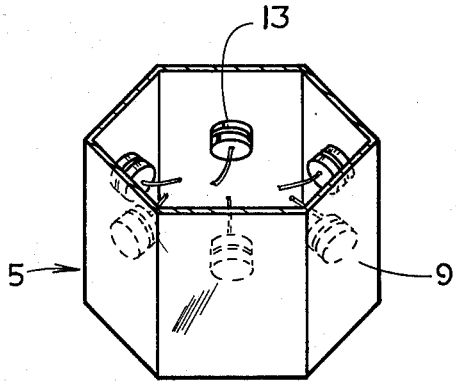
FIG. 2 is an enlarged perspective view, partially cut-away, of the ultrasonic vibrating member shown in FIG. 1.

Attached to each of the side walls of the vibrating member 5 is at least one ultrasonic transducer 13, one transducer being shown on each wall in FIGS. 2 and 3. The transducers 13 are located on the inner surfaces of the said walls and do not come in contact with the cleaning solution. Transducers 13, as shown, are of the electrostrictive type but it is realized that other types of transducers, for instance magnitostrictive transducers, may also be employed without departing from the principles of the present invention. Furthermore, the front face of transducers 13 are attached to the vibrating member 5 by any known means.

As used in the present invention, the word transducer is meant to be a device to convert electrical energy to mechanical energy. In this case, the supplying of 25 KHZ electrical energy to a compression transducer utilizing lead zirconate titanate resonant material is one example. One or more of these units are attached to a vibrating plate (diaphragm) which moves at approximately the same frequency. This vibration transmits pressure waves in a liquid medium causing cavitation. However, it is realized that the use of other frequencies or resonant type devices are within the scope and spirit of the present invention.

Disposed separately from container 1 is an ultrasonic generator (not shown) which is a commercially used common emitter of converted frequency and receives its low voltage, low frequency input from an AC power line (not shown). It is understood that any other conversion circuit may be used which converts 60 HZ or other line frequency electrical energy to high frequency energy suitable for operating the transducers 13, the energy being transmitted from the ultrasonic generator to the transducers 13 through electrical lines or cable 15.

Electrical cable 15 is usually contained in either rigid or flexible tubing, cable 15 being attached to the transducers 13 through the top end 11 of the vibrating member 5 by a compression fitting 17 welded to the top end 11 and compressed on the tubing to provide a leak tight joint.

In the operation of the ultrasonic cleaning apparatus of FIG. 1, the container 1 including vibrating member 5 therein is filled with a suitable cleaning solvent 3 which is usually an organic solvent such as the chlorinated hydrocarbons, for example, trichloromonofluoromethane, trichlorotrifluoroethane, trichloroethylene, carbon tetrachloride, and the like or etching solutions such as hydrochloric acid and the like. This system can also be used with water based materials. Ultrasonic vibrations are then started by energizing the vibrating member 5, the ultrasonic vibrations, as shown in FIG. 1, being directed in six different directions thereby causing violent agitation within the container 1. An object which is to be cleaned may then be inserted into container 1 through the opening in the top for a short period of time and then removed therefrom or the container itself may be cleaned.

It is realized that the vibrating member 5 may be mounted in many different types of containers such as cylinders or chemical distillation columns where acid cleaning, for example, is employed and difficult to accomplish.

FIG. 4 shows an example of another vibrating member which may be utilized in the present invention. In FIG. 4 the vibrating member is a three-sided member 19 having at least one transducer 21 mounted onto the inner surface of each side wall. An electrical cable 23 is provided to transmit energy to the transducers 21 from an ultrasonic generator source (not shown). It is realized that other vibrating members having any number of sides may be utilized in the present invention wherein at least one transducer is mounted onto the inner surface of each side wall thereof.

It is to be understood that the forms of my invention hereindescribed and shown are only examples of shape, size, and arrangement of parts that may be resorted to without departing from the scope and spirit of my invention.

What is claimed is:

1. An ultrasonic cleaning apparatus comprising:

(a) a container for a liquid having an open top;

(b) an enclosed vibrating housing disposed within said container, said housing having at least three sides;

(c) at least one ultrasonic transducer attached to the inner surface of each side; and, (d) means for providing electrical energy to said transducer.

2. The ultrasonic cleaning apparatus of claim 1, said vibrating housing being centrally disposed from each side of said container.

3. The ultrasonic cleaning apparatus of claim 1 wherein said means for providing electrical energy to said transducer includes electrical input lines to said transducer for electrical communication with an ultrasonic generator, the lines being contained in tubing, the tubing being inserted through said vibrating housing and attached thereto by a compression fitting welded to said housing and compressed on said tubing to provide a leak tight joint.

4. The ultrasonic cleaning apparatus of claim 1 including support means, said vibrating housing being attached to and supported by said support means, said support means extending through said open top.

* * * * *